US010233665B1

(12) United States Patent
Lee

(10) Patent No.: US 10,233,665 B1
(45) Date of Patent: Mar. 19, 2019

(54) COMBINATION TENT

(71) Applicant: Wonderland Adventure Co., Ltd., Taoyuan (TW)

(72) Inventor: Shu-Fang Lee, Taoyuan (TW)

(73) Assignee: Wonderland Adventure Co., Ltd., Taoyuan (TW)

( * ) Notice: Subject to any disclaimer, the term of this patent is extended or adjusted under 35 U.S.C. 154(b) by 0 days.

(21) Appl. No.: 15/990,796

(22) Filed: May 28, 2018

(51) Int. Cl.
*E04H 15/18* (2006.01)
*E04H 15/40* (2006.01)
*E04H 15/32* (2006.01)
*E04H 15/64* (2006.01)

(52) U.S. Cl.
CPC ..... *E04H 15/18* (2013.01); *E04H 15/40* (2013.01); *E04H 15/64* (2013.01); *E04H 2015/328* (2013.01)

(58) Field of Classification Search
CPC ... E04H 15/02; E04H 15/06; E04H 2015/328; E04H 15/36; E04H 15/40; E04H 15/54; E04H 15/18
See application file for complete search history.

(56) References Cited

U.S. PATENT DOCUMENTS 794,036 A * 7/1905 McCall ..... E04H 15/18 135/125
1,820,412 A * 8/1931 Warren ..... E04H 15/18 135/116
3,965,915 A * 6/1976 Kirkham ..... E04H 15/18 135/97
4,102,352 A * 7/1978 Kirkham ..... E04H 15/30 135/115
4,114,633 A * 9/1978 Herbez ..... E04H 15/06 135/97
5,313,972 A * 5/1994 Goldberg ..... E04H 15/06 135/116
6,273,114 B1 * 8/2001 Schaefer ..... E04H 15/18 135/128
7,146,996 B1 * 12/2006 Shires ..... E04H 15/36 135/126
2005/0139247 A1 * 6/2005 Chuang ..... E04H 15/02 135/88.04
2009/0065037 A1 * 3/2009 Hauschild ..... E04H 15/40 135/97

(Continued)

FOREIGN PATENT DOCUMENTS

WO WO-2015031618 A1 * 3/2015 ..... E04H 15/30

*Primary Examiner* — David R Dunn
*Assistant Examiner* — Danielle Jackson
(74) *Attorney, Agent, or Firm* — Alan D. Kamrath; Kamrath IP Lawfirm, P.A.

(57) ABSTRACT

A combination tent includes a tent frame standing upright on the ground. An outer tent fabric is spread out and mounted on the tent frame. The outer tent fabric encloses an arched space having front and rear ends that are open. An outer tent door fabric is disposed on a first side of the outer tent fabric and is openable and closeable. An inner tent is disposed in the arched space and is connected to the first side of the outer tent fabric. An inner tent door fabric is disposed on a side of the inner tent, is aligned with the outer tent door fabric, and is openable and closeable. The arched space includes an open passage defined between another side of the inner tent and a second side of the outer tent fabric. The open passage extends from the front end to the rear end of the arched space.

8 Claims, 10 Drawing Sheets

(56) References Cited

U.S. PATENT DOCUMENTS

| | | | | |
|---|---|---|---|---|
| 2009/0188539 | A1* | 7/2009 | Hollinger | E04H 15/22 135/115 |
| 2012/0186618 | A1* | 7/2012 | Arredondo | E04H 15/42 135/96 |
| 2013/0333737 | A1* | 12/2013 | Williams | E04H 15/18 135/97 |
| 2014/0150836 | A1* | 6/2014 | Bourland | E04H 15/001 135/96 |

* cited by examiner

COMBINATION TENT

BACKGROUND OF THE INVENTION

The present invention relates to a tent and, more particularly, to a combination tent in which persons can rest and at least one motorcycle or at least one bicycle can be parked.

With the improvement of quality of life, modern people more and more value leisure life activities and start travelling by motorcycles and bicycles. To enjoy outdoor activities and to permit convenient rest, most people choose to set up a tent in the wild.

Currently available tents consist of a tent frame and tent fabrics to provide a space for people to rest and sleep. However, the motorcycles or bicycles can only parked outside of the tents and are, thus, exposed to the sunlight and rain as well as easy theft. Thus, a need exists for a novel tent that mitigates and/or obviate these drawbacks.

BRIEF SUMMARY OF THE INVENTION

The primary objective of the present invention is to provide a combination tent

To fulfill the above objective, the present invention provides a combination tent including a tent frame having an arcuate shape and standing upright on the ground. The tent frame includes an open front end and an open rear end spaced from the open front end in a longitudinal direction. An outer tent fabric is spread out and mounted on the tent frame. The outer tent fabric encloses an arched space having front and rear ends that are open. The outer tent fabric includes first and second sides spaced from each other in a lateral direction perpendicular to the longitudinal direction. An outer tent door fabric is disposed on the first side of the outer tent fabric. The outer tent door fabric is openable and closeable. An inner tent extends in the longitudinal direction and disposed in the arched space. The inner tent is connected to the first side of the outer tent fabric. The inner tent includes a bottom fabric and a top fabric connected to and enclosing a periphery of the bottom fabric. The top fabric and the bottom fabric define a receiving space therebetween. An inner tent door fabric is disposed on a side of the inner tent defining the receiving space and is aligned with the outer tent door fabric. The inner tent door fabric is openable and closeable. The arched space includes an open passage defined between another side of the inner tent and the second side of the outer tent fabric. The open passage extends in the longitudinal direction from the front end to the rear end of the arched space.

In an example, the outer tent fabric further includes a front tubular fabric disposed along a front edge thereof and a rear tubular fabric disposed along a rear edge thereof. Bottoms of the first and second sides of the outer tent fabric are adjacent to the ground. A front fixing strap is interconnected between front ends of the first and second sides of the outer tent fabric. A rear fixing strap is interconnected between rear ends of the first and second sides of the outer tent fabric. The tent frame includes a flexible front pole extending through the front tubular fabric and a flexible rear pole extending through the rear tubular fabric. Each of the flexible front pole and the flexible rear pole is bent into the arched shape.

In an example, the first side of the outer tent fabric includes a front end and a rear end. A front connecting fabric and a rear connecting fabric are respectively disposed on the front and rear ends of the first side of the outer tent fabric. A plurality of connecting straps is mounted to front and rear ends of the inner tent and is respectively connected to the front and rear connecting fabrics.

In an example, a front, inclined fabric is connected to a front end of one of the first and second sides of the outer tent fabric and extends forward and downward to shield a front end of the inner tent.

In an example, the front, inclined fabric includes a bottom edge connected to an extension fabric extending toward the inner tent.

In an example, a rear, inclined fabric is connected to a rear end of one of the first and second sides of the outer tent fabric and extends rearward and downward to shield a rear end of the inner tent.

The present invention will become clearer in light of the following detailed description of illustrative embodiments of this invention described in connection with the drawings.

DETAILED DESCRIPTION OF THE INVENTION

Figure 1:
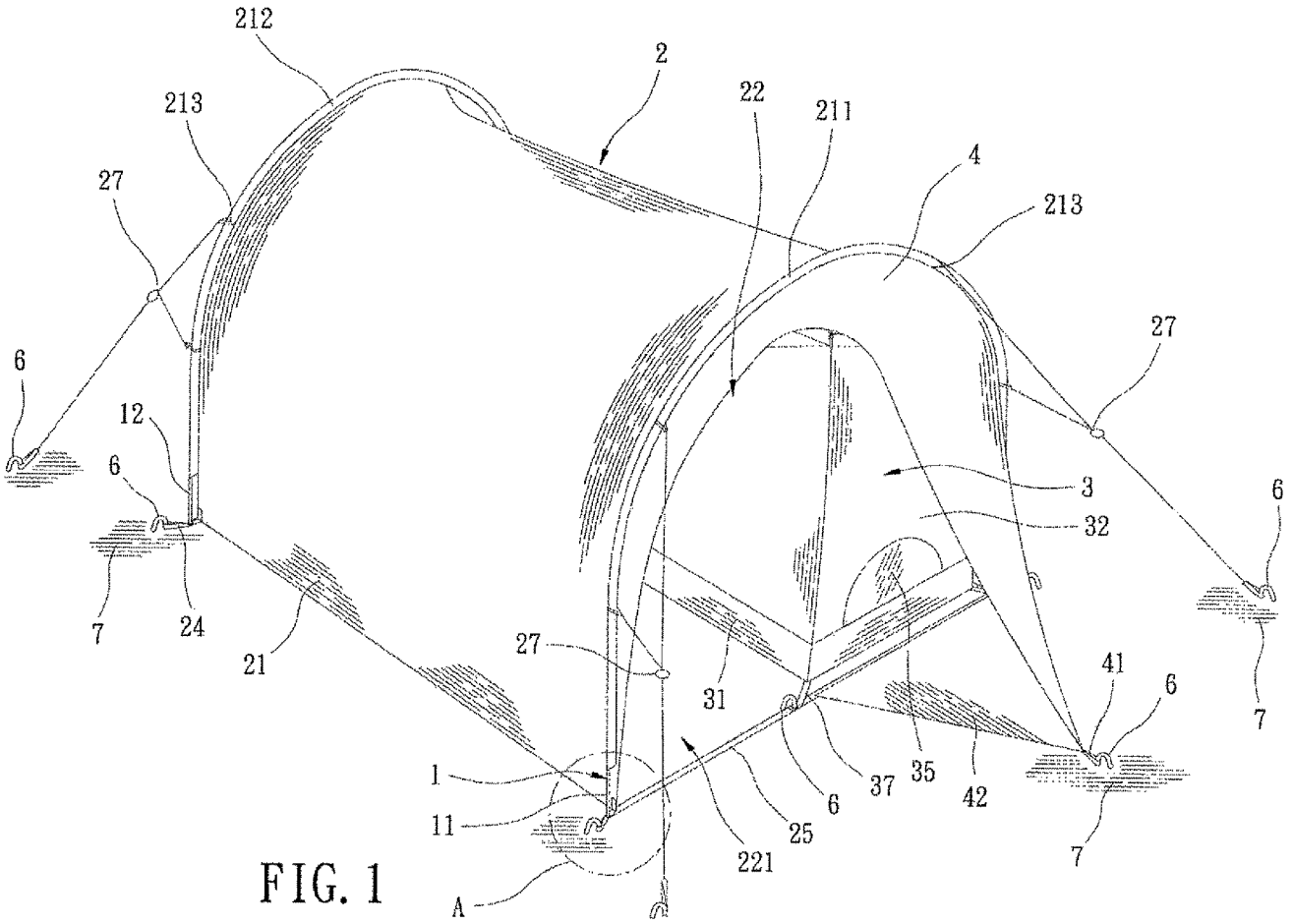
FIG. 1 is a perspective view illustrating use of a combination tent of an embodiment according to the present invention and pull strings.
Figure 2:
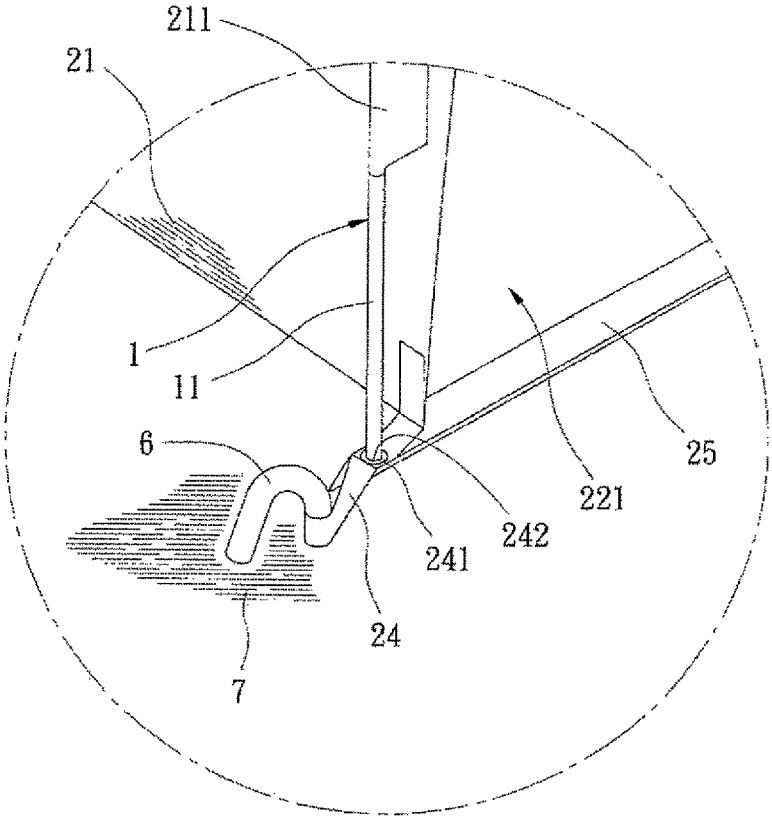
FIG. 2 is an enlarged view of a circled portion of FIG. 1.
Figure 3:
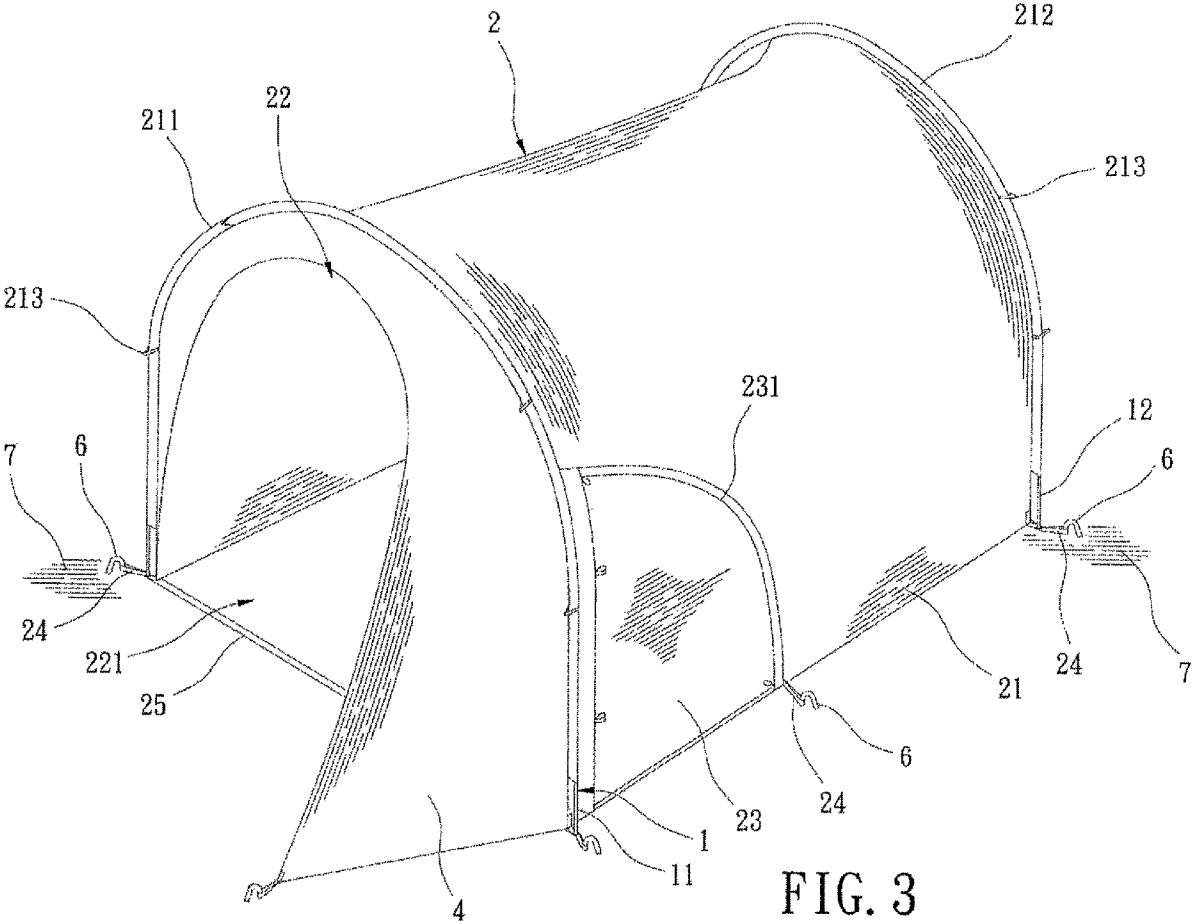
FIG. 3 is a front, perspective view of the combination tent according to the present invention.
Figure 4:
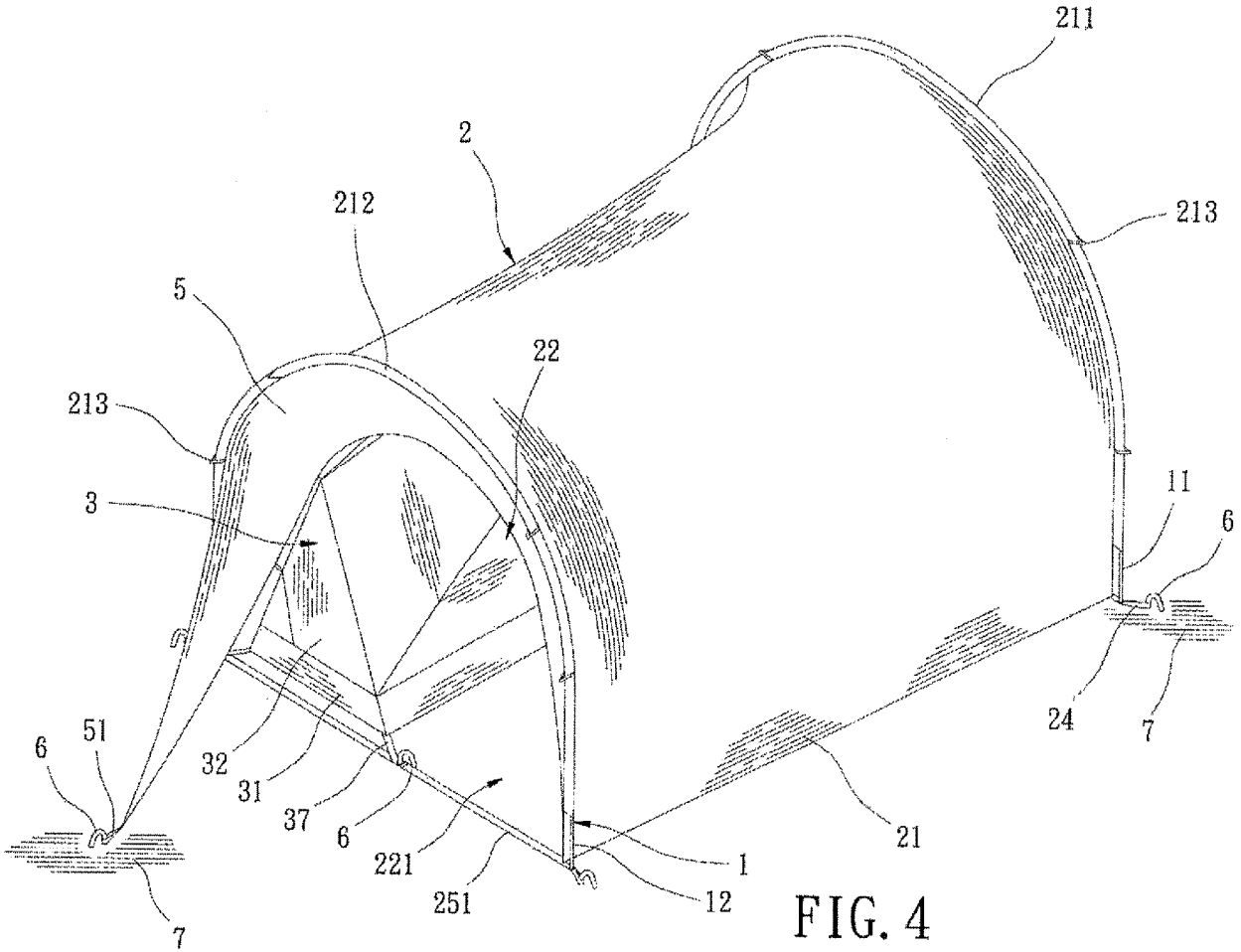
FIG. 4 is a rear, perspective view of the combination tent according to the present invention.
Figure 5:
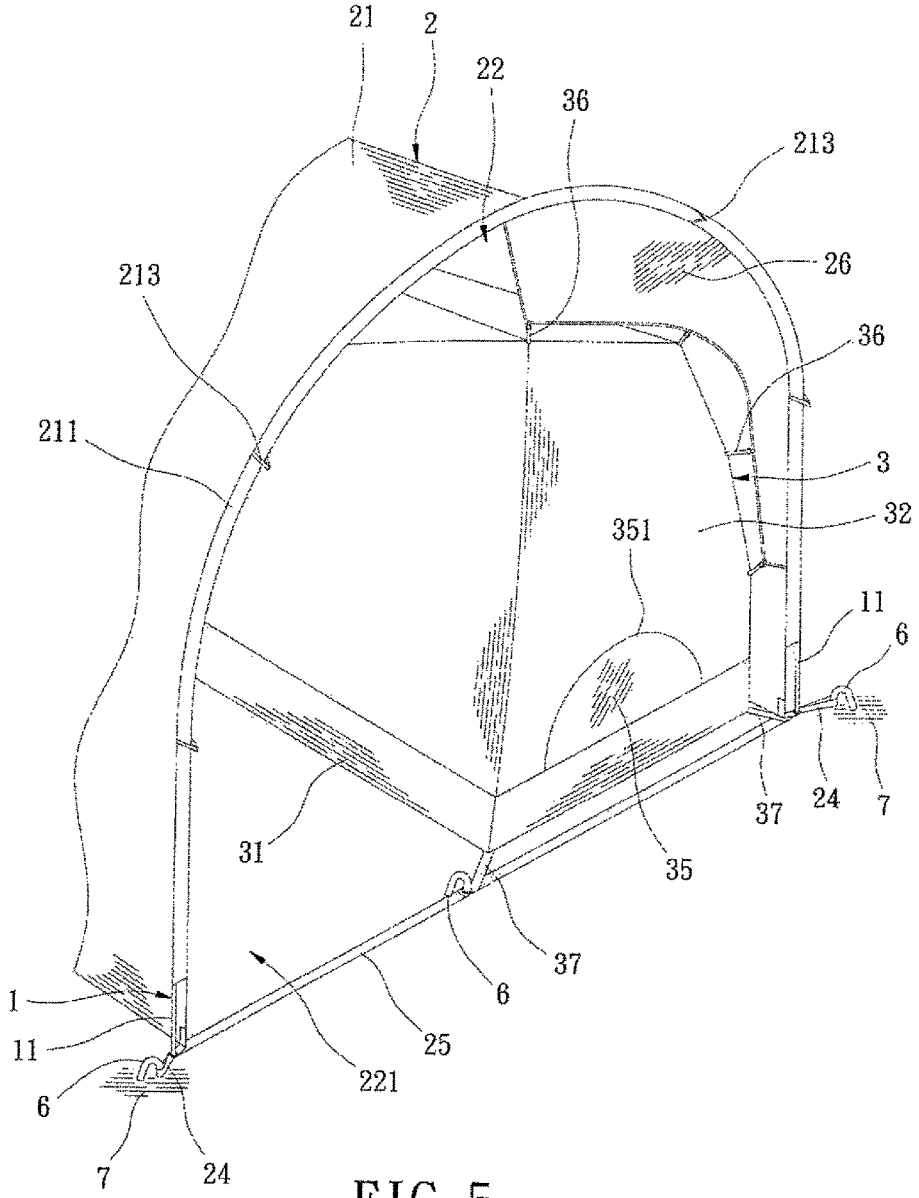
FIG. 5 is a partial, perspective view of the combination tent with a front, inclined fabric removed.
Figure 6:
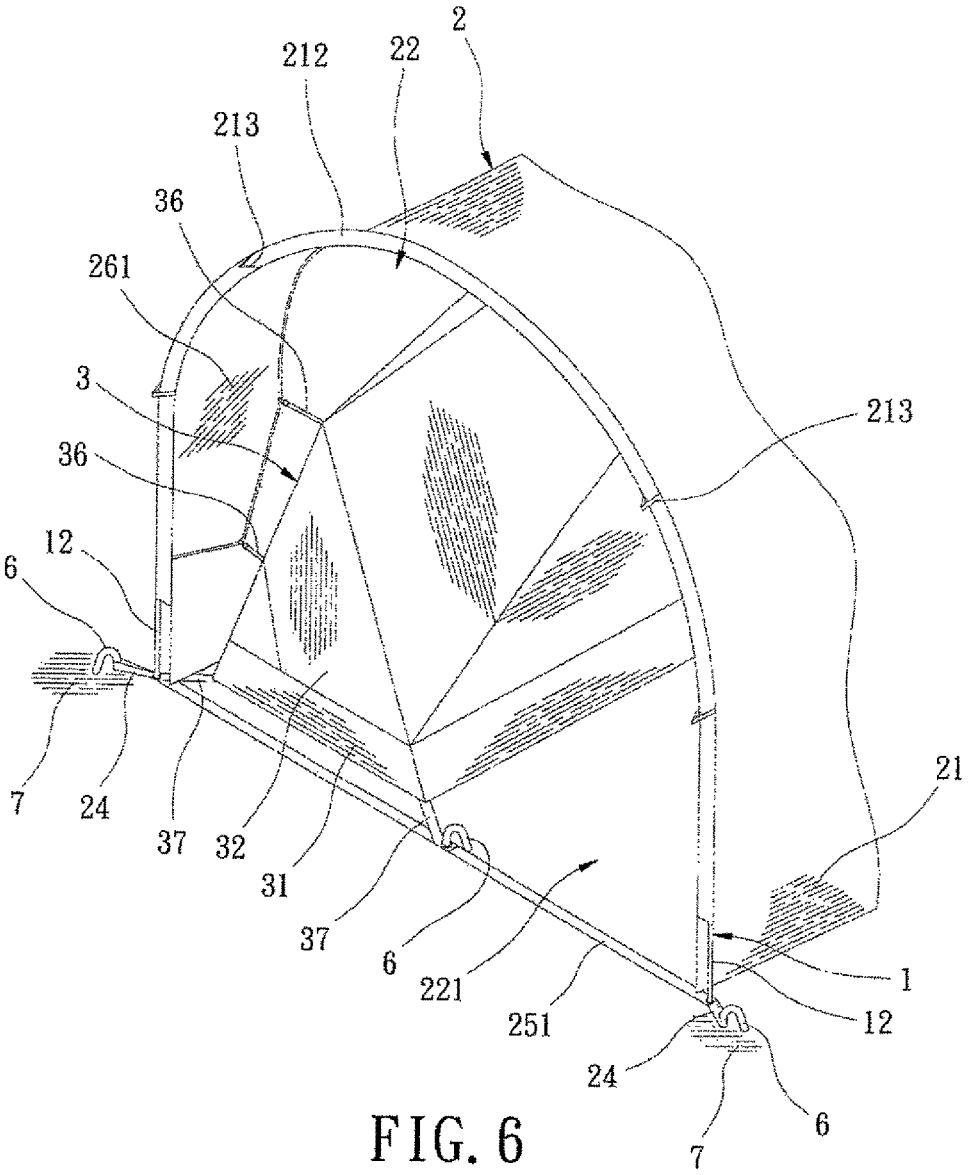
FIG. 6 is a partial, perspective view of the combination tent with a rear, inclined fabric removed.
Figure 7:
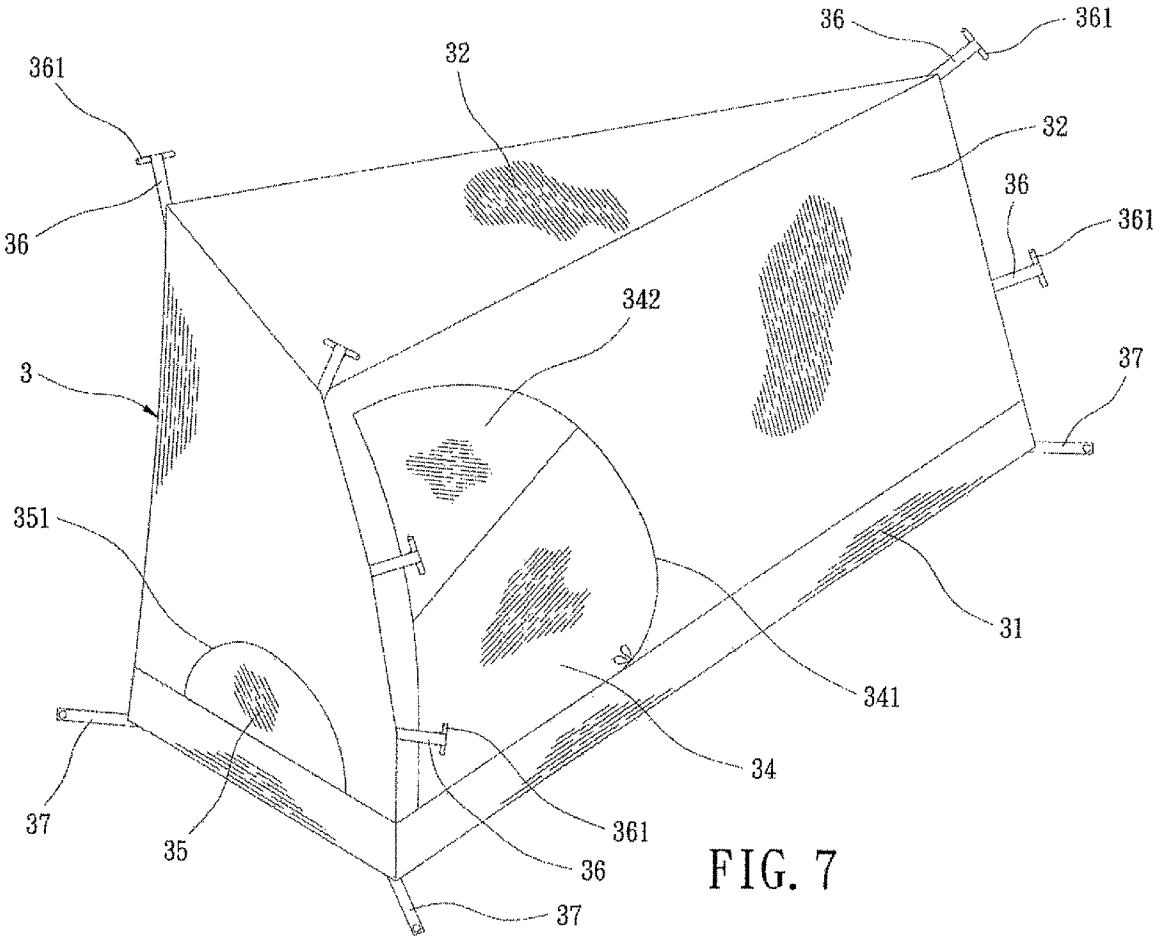
FIG. 7 is a front, perspective view of an inner tent of the combination tent according to the present invention.

With reference to FIGS. 1-7, a combination tent according to the present invention includes a tent frame 1, an outer tent fabric 2, an inner tent 3, a front, inclined fabric 4, and a rear inclined fabric 5.

The outer tent frame 1 includes a flexible front pole 11 at a front end thereof and a flexible rear pole 12 at a rear end thereof. Each of the flexible front and rear poles 11 and 12 is bent into an arched shape and stands upright on the ground 7. The front and rear ends of the tent frame 1 are open and spaced from each other in a longitudinal direction.

The outer tent fabric 2 is a waterproof fabric 21. A front tubular fabric 211 is disposed along a front edge of the waterproof fabric 21, and a plurality of connecting rings 213 is disposed on the front tubular fabric 211 and is spaced from each other. A rear tubular fabric 212 is disposed along a rear edge of the waterproof fabric 21, and a plurality of connecting rings 213 is disposed on the rear tubular fabric 212 and is spaced from each other. The flexible front and rear poles 11 and 12 extend through inner holes of the front and rear tubular fabrics 211, respectively and are bent into the arched shape.

The outer tent fabric 2 is spread out and mounted on the tent frame 1. The outer tent fabric 2 includes first and second sides spaced from each other in a lateral direction perpendicular to the longitudinal direction. Each of the first and second sides of the outer tent fabric 2 includes a front end and a rear end spaced from the front end in the longitudinal direction. Bottoms of the first and second sides of the outer tent fabric 2 are adjacent to the ground. The outer tent fabric 2 encloses an arched space 22 having front and rear ends that are open. Each of the plurality of connecting rings 213 is connected to a respective one of a plurality of connecting string unit 27 and is fixed by a respective one of a plurality of pegs 6 to the ground 7. An outer tent door fabric 23 is disposed on the first side of the outer tent fabric 2 and is openable and closeable through use of a zipper fastener 231 (see FIG. 3).

Each corner of the outer tent fabric 2 has a fixing loop 24 to be fixed by a peg 6 to the ground 7. A front fixing strap 25 is interconnected between the front ends of the first and second sides of the outer tent fabric 2 and can be interconnected between two fixing loops 24 at the front end of the outer tent fabric 2. A rear fixing strap 251 is interconnected between the rear ends of the first and second sides of the outer tent fabric 2 and can be interconnected between two fixing loops 24 at the rear end of the outer tent fabric 2. Two ends of the flexible front pole 11 extend through holes 242 of eyelets 241 of the two fixing loops 24 at the front end of the outer tent fabric 2 (see FIG. 2). Two ends of the flexible rear pole 12 extend through holes 242 of eyelets 241 of the two fixing loops 24 at the rear end of the outer tent fabric 2. A front connecting fabric 26 and a rear connecting fabric 261 are respectively disposed on the front and rear ends of the first side of the outer tent fabric 2 (see FIGS. 5 and 6).

The inner tent 3 can be a one-man tent or a two-man tent. The inner tent 3 extends in the longitudinal direction and is disposed in the arched space 22. The inner tent 3 includes a front end and a rear end spaced from the front end in the longitudinal direction. The front and rear ends of the inner tent 3 are provided with a plurality of connecting straps 36 and a plurality of couplers 361 (see FIGS. 5, 6, and 7) for connecting with the front connecting strap 26 and the rear connecting strap 261. A plurality of connecting straps 37 is mounted to the corners of the inner tent 3 and is respectively connected to the front and rear connecting fabrics 26 and 261 to cooperate with the fixing loops 24, the front and rear fixing straps 25 and 251, and respective pegs 6 for fixing to the ground 7.

Figure 8:
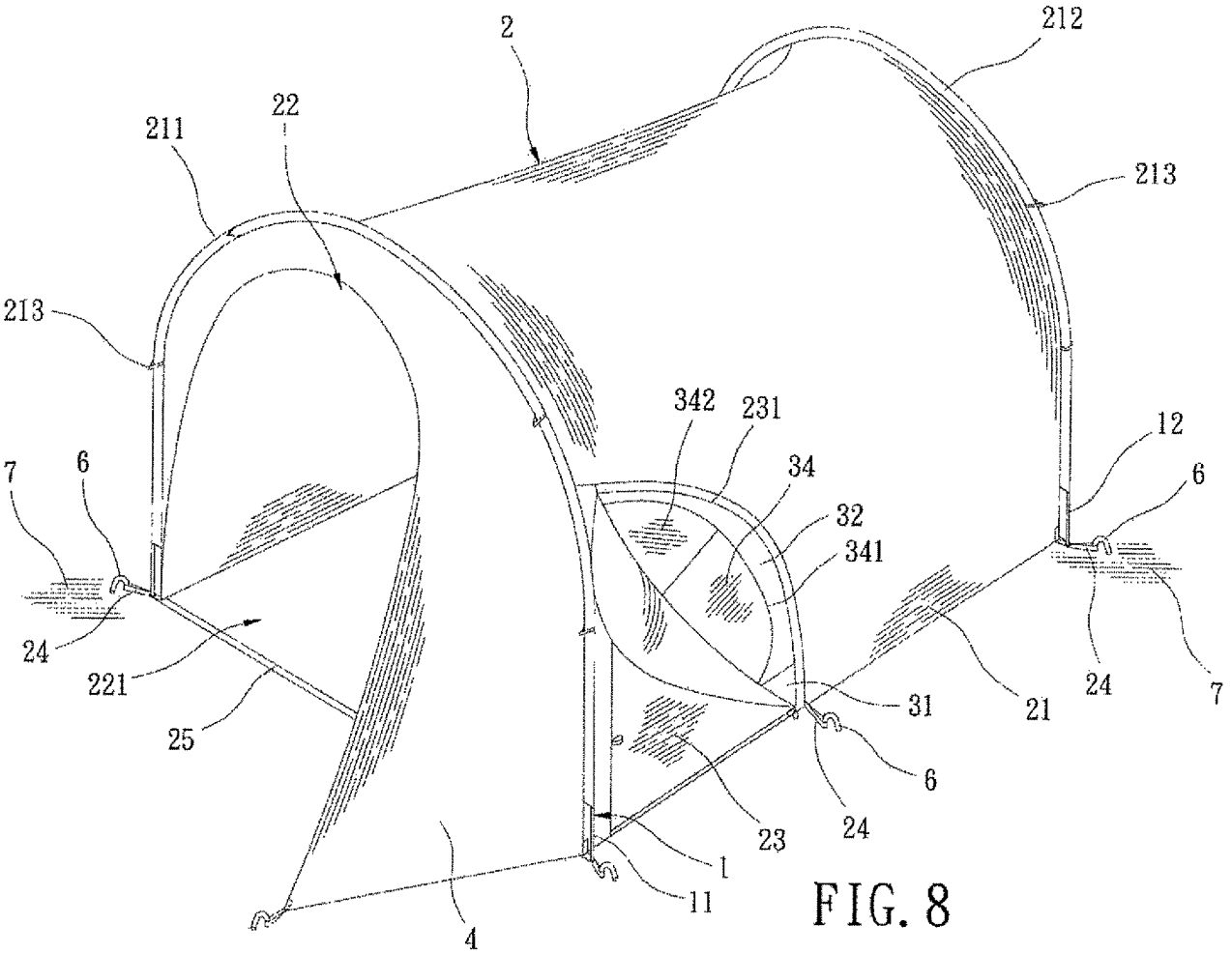
FIG. 8 is a perspective view of the combination tent with an outer tent door fabric opened.
Figure 9:
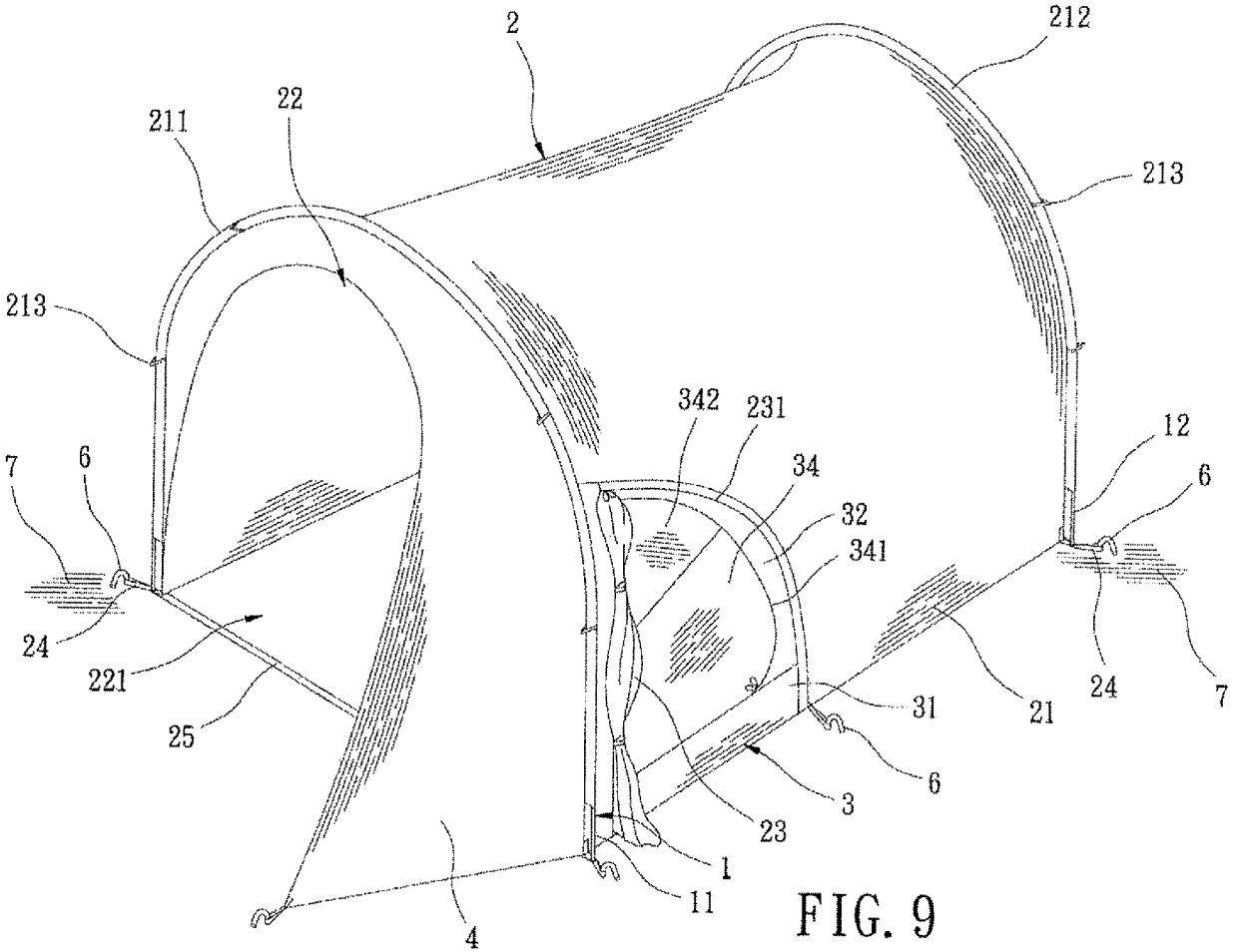
FIG. 9 is a perspective view of the combination tent with the outer tent door fabric coiled.
Figure 10:
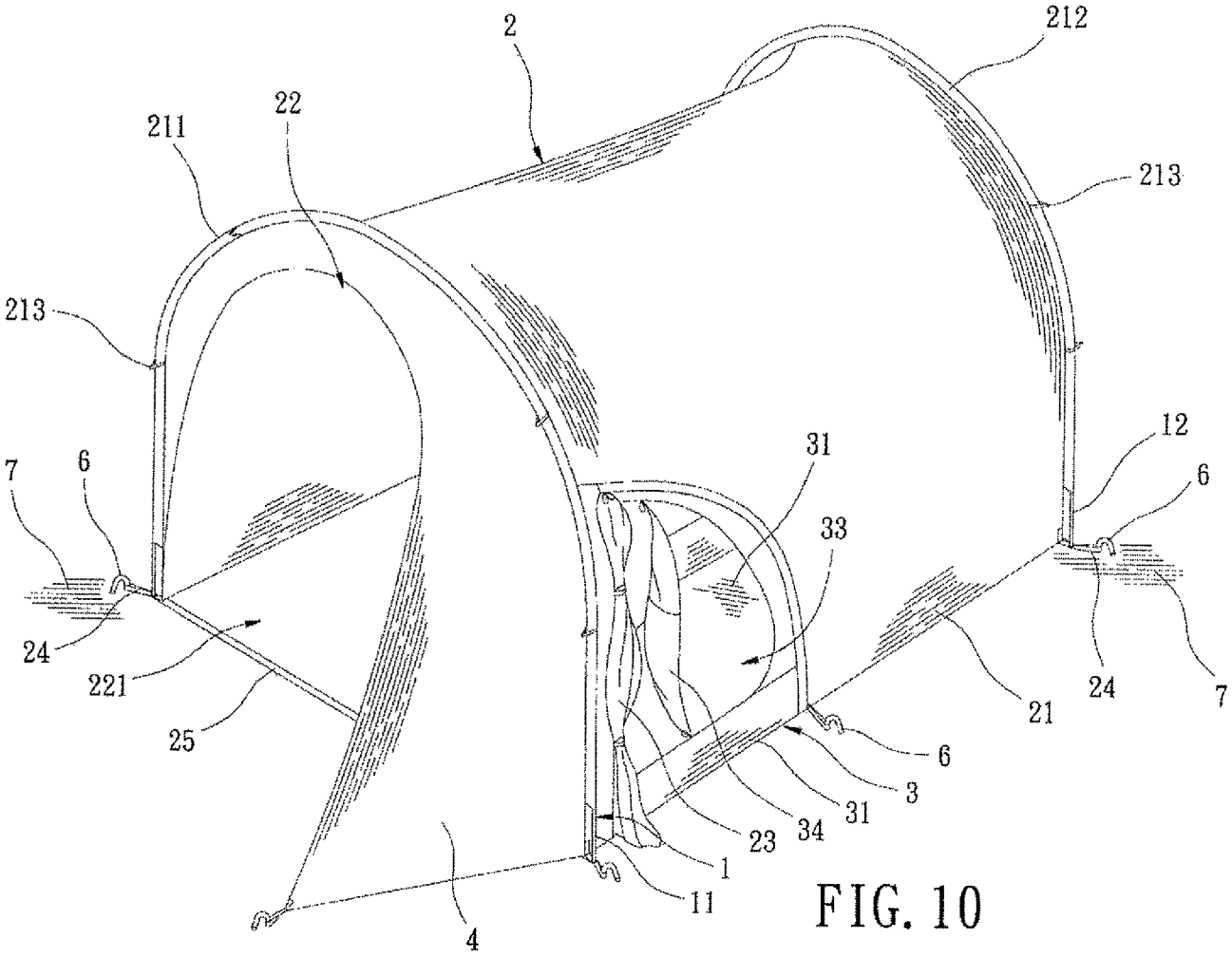
FIG. 10 is a perspective view of the combination tent with an inner tent door fabric opened.

The inner tent 3 is connected to the first side of the outer tent fabric 2. The inner tent 3 includes a bottom fabric 31 that is waterproof and a top fabric 32 that is waterproof and that is connected to and encloses a periphery of the bottom fabric 31, with the top fabric 32 and the bottom fabric 31 defining a receiving space 33 therebetween (see FIG. 10). An inner tent door fabric 34 is disposed on a side of the inner tent 3 and is aligned with the outer tent door fabric 23. The inner tent door fabric 34 is openable and closeable by the provision of a zipper fastener 341 (see FIGS. 8-10). Furthermore, the front end of the inner tent 3 is provided with a window fabric 5 with a zipper fastener 351. The arched space 22 includes an open passage 221 defined between another side of the inner tent 3 and the second side of the outer tent fabric 2. The open passage 221 extends in the longitudinal direction from the front end to the rear end of the arched space 22.

The front, inclined fabric 4 is connected to the front end of one of the first and second sides of the outer tent fabric 2. The front, inclined fabric 4 extends forward and downward and cooperates with fixing loops 41 and respective pegs 6 for fixing to the ground 7. Thus, the front, inclined fabric 4 shields the sunlight and assists in positioning of the tent frame 1. The front, inclined fabric 4 includes a bottom edge connected to an extension fabric 42 extending toward the inner tent 3. The extension fabric 42 is fixed to the front, fixing strap 25, and objects (not shown) can be placed on the extension fabric 42.

The rear, inclined fabric 5 is connected to the rear end of one of the first and second sides of the outer tent fabric 2. The rear, inclined fabric 5 extends rearward and downward and cooperates with fixing loops 51 and respective pegs 6 for fixing to the ground 7. Thus, the rear, inclined fabric 5 shields the rear end of the inner tent 3 from the sunlight and assists in positioning of the tent frame 1.

In use of the combination tent according to the present invention, the outer tent fabric 2 is spread out and mounted on the tent frame 1 to form the arched space 22 having open front and rear ends. The inner tent 3 extends in the longitudinal direction and is disposed in the arched space 22. The inner tent 3 is connected to the first side of the outer tent fabric 2 and defines a receiving space 33 therein (see FIG. 10). Furthermore, the openable/closeable inner tent door fabric 34 of the inner tent 3 aligned with the outer tent door fabric 23 of the outer tent fabric 2 permits a user or users to enter the inner tent 3 for rest and sleep. Furthermore, at least one motorcycle or at least one bicycle can be moved into or out of the open passage 221 between the another side of the inner tent 3 and the second side of the outer tent fabric 2 via the front end or the rear end of the open passage 221. Consequently, the at least one motorcycle or at least one bicycle can be parked in the open passage and, thus, can be shielded from the sunlight while reducing the risks of theft.

Although specific embodiments have been illustrated and described, numerous modifications and variations are still possible without departing from the scope of the invention. The scope of the invention is limited by the accompanying claims.

The invention claimed is:

1. A combination tent comprising:

a tent frame having an arcuate shape and standing upright on a ground, wherein the tent frame includes an open front end and an open rear end spaced from the open front end in a longitudinal direction;

an outer tent fabric spread out and mounted on the tent frame, wherein the outer tent fabric encloses an arched space having front and rear ends that are open, wherein the outer tent fabric includes first and second sides spaced from each other in a lateral direction perpendicular to the longitudinal direction, wherein an outer tent door fabric is disposed on the first side of the outer tent fabric, and wherein the outer tent door fabric is openable and closeable; and an inner tent extending in the longitudinal direction and disposed in the arched space, wherein the inner tent is connected to the first side of the outer tent fabric, wherein the inner tent includes a bottom fabric and a top fabric connected to and enclosing a periphery of the bottom fabric, wherein the top fabric and the bottom fabric define a receiving space therebetween, wherein an inner tent door fabric is disposed on a side of the inner tent and is aligned with the outer tent door fabric, wherein the inner tent door fabric is openable and closeable, wherein the arched space includes an open passage defined between another side of the inner tent and the second side of the outer tent fabric, and wherein the open passage extends in the longitudinal direction from the front end to the rear end of the arched space, wherein the outer tent fabric further includes a front tubular fabric disposed along a front edge thereof and a rear tubular fabric disposed along a rear edge thereof, wherein bottoms of the first and second sides of the outer tent fabric are adjacent to the ground, wherein a front fixing strap is interconnected between front ends of the first and second sides of the outer tent fabric, wherein a rear fixing strap is interconnected between rear ends of the first and second sides of the outer tent fabric, wherein the tent frame includes a flexible front pole extending through the front tubular fabric and a flexible rear pole extending through the rear tubular fabric, and wherein each of the flexible front pole and the flexible rear pole is bent into the arched shape.

2. The combination tent as claimed in claim 1, wherein a front, inclined fabric is connected to a front end of one of the first and second sides of the outer tent fabric and extends forward and downward to shield a front end of the inner tent.

3. The combination tent as claimed in claim 1, wherein a rear, inclined fabric is connected to a rear end of one of the first and second sides of the outer tent fabric and extends rearward and downward to shield a rear end of the inner tent.

4. A combination tent comprising:

a tent frame having an arcuate shape and standing upright on a ground, wherein the tent frame includes an open front end and an open rear end spaced from the open front end in a longitudinal direction;

an outer tent fabric spread out and mounted on the tent frame, wherein the outer tent fabric encloses an arched space having front and rear ends that are open, wherein the outer tent fabric includes first and second sides spaced from each other in a lateral direction perpendicular to the longitudinal direction, wherein an outer tent door fabric is disposed on the first side of the outer tent fabric, and wherein the outer tent door fabric is openable and closeable; and an inner tent extending in the longitudinal direction and disposed in the arched space, wherein the inner tent is connected to the first side of the outer tent fabric, wherein the inner tent includes a bottom fabric and a top fabric connected to and enclosing a periphery of the bottom fabric, wherein the top fabric and the bottom fabric define a receiving space therebetween, wherein an inner tent door fabric is disposed on a side of the inner tent and is aligned with the outer tent door fabric, wherein the inner tent door fabric is openable and closeable, wherein the arched space includes an open passage defined between another side of the inner tent and the second side of the outer tent fabric, and wherein the open passage extends in the longitudinal direction from the front end to the rear end of the arched space, wherein the first side of the outer tent fabric includes a front end and a rear end, wherein a front connecting fabric and a rear connecting fabric are respectively disposed on the front and rear ends of the first side of the outer tent fabric, wherein a plurality of connecting straps is mounted to front and rear ends of the inner tent and is respectively connected to the front and rear connecting fabrics.

5. The combination tent as claimed in claim 4, wherein a front, inclined fabric is connected to a front end of one of the first and second sides of the outer tent fabric and extends forward and downward to shield a front end of the inner tent.

6. The combination tent as claimed in claim 4, wherein a rear, inclined fabric is connected to a rear end of one of the first and second sides of the outer tent fabric and extends rearward and downward to shield a rear end of the inner tent.

7. A combination tent comprising:

a tent frame having an arcuate shape and standing upright on a ground, wherein the tent frame includes an open front end and an open rear end spaced from the open front end in a longitudinal direction;

an outer tent fabric spread out and mounted on the tent frame, wherein the outer tent fabric encloses an arched space having front and rear ends that are open, wherein the outer tent fabric includes first and second sides spaced from each other in a lateral direction perpendicular to the longitudinal direction, wherein an outer tent door fabric is disposed on the first side of the outer tent fabric, and wherein the outer tent door fabric is openable and closeable; and an inner tent extending in the longitudinal direction and disposed in the arched space, wherein the inner tent is connected to the first side of the outer tent fabric, wherein the inner tent includes a bottom fabric and a top fabric connected to and enclosing a periphery of the bottom fabric, wherein the top fabric and the bottom fabric define a receiving space therebetween, wherein an inner tent door fabric is disposed on a side of the inner tent and is aligned with the outer tent door fabric, wherein the inner tent door fabric is openable and closeable, wherein the arched space includes an open passage defined between another side of the inner tent and the second side of the outer tent fabric, and wherein the open passage extends in the longitudinal direction from the front end to the rear end of the arched space, wherein a front, inclined fabric is connected to a front end of one of the first and second sides of the outer tent fabric and extends forward and downward to shield a front end of the inner tent, and wherein the front, inclined fabric includes a bottom edge connected to an extension fabric extending toward the inner tent.

8. The combination tent as claimed in claim 7, wherein a rear, inclined fabric is connected to a rear end of one of the first and second sides of the outer tent fabric and extends rearward and downward to shield a rear end of the inner tent.

* * * * *